United States Patent [19]

Rhoades

[11] Patent Number: 4,911,570

[45] Date of Patent: Mar. 27, 1990

[54] ENCLOSURE MEANS FOR LIQUID APPLICATORS

[76] Inventor: Clark J. Rhoades, 181 Tweed Blvd., Nyack, N.Y. 10960

[21] Appl. No.: 175,575

[22] Filed: Mar. 28, 1988

Related U.S. Application Data

[63] Continuation-in-part of Ser. No. 78,229, Jul. 27, 1987, abandoned.

[51] Int. Cl.[4] ..... B43K 9/00

[52] U.S. Cl. ..... 401/108; 401/107; 401/117

[58] Field of Search ..... 401/107, 108, 117, 99, 401/65, 67, 166, 83

[56] References Cited

U.S. PATENT DOCUMENTS

| | | | |
|---|---|---|---|
| 971,797 | 10/1910 | Smythe | 401/91 |
| 1,714,965 | 5/1929 | Ullner | 401/107 |
| 1,839,817 | 1/1932 | Walker | 401/107 |
| 2,291,859 | 8/1942 | Andrews | 401/107 |
| 2,373,711 | 4/1945 | Satz et al. | 15/172 |
| 2,559,555 | 7/1951 | Zepelovitch | 401/104 |
| 3,035,299 | 5/1962 | Gordon et al. | 401/107 |
| 3,224,030 | 12/1965 | Maichen | 401/271 |
| 3,480,370 | 11/1969 | Koeln | 401/107 |
| 3,583,820 | 6/1971 | Koeln | 401/107 |
| 3,637,316 | 1/1973 | Bross | 401/104 |
| 3,945,734 | 3/1976 | Woodbridge | 401/198 |
| 4,218,154 | 9/1985 | Erfer | 401/107 |
| 4,540,300 | 9/1985 | Midorikawa | 401/107 |
| 4,544,297 | 10/1985 | Grossiord | 401/217 |
| 4,575,271 | 3/1986 | Hasimoto et al. | 401/107 |
| 4,595,307 | 6/1986 | Heyden | 401/117 |
| 4,629,348 | 12/1986 | Hasimoto et al. | 401/107 |
| 4,640,637 | 2/1987 | Winthrop | 401/101 |
| 4,711,592 | 12/1987 | Gregory | 401/107 |

FOREIGN PATENT DOCUMENTS

| | | | |
|---|---|---|---|
| 219001 | 4/1987 | European Pat. Off. | 401/65 |
| 1561813 | 4/1970 | Fed. Rep. of Germany | 401/107 |
| 2752304 | 7/1978 | Fed. Rep. of Germany | 401/108 |
| 8502149 | 5/1985 | Fed. Rep. of Germany | 401/108 |
| 2821625 | 11/1987 | Fed. Rep. of Germany | 401/67 |
| 1307934 | 9/1962 | France | 401/99 |
| 1424491 | 12/1965 | France | 407/107 |
| 2220353 | 10/1974 | France | 401/108 |
| 3071 | of 1863 | United Kingdom | 104/83 |
| 166333 | 7/1921 | United Kingdom | 401/108 |

OTHER PUBLICATIONS

Noryl Design Guide; General Electric, 6/84, pp. 44–45.

*Primary Examiner*—Richard J. Apley
*Assistant Examiner*—D. F. Crosby
*Attorney, Agent, or Firm*—John H. Crozier

[57] ABSTRACT

A sealing device for a liquid applicator of the type having a liquid applicator tip, with open and sealed positions. The end of the applicator through which the tip extends is petallate, with the petals sloped toward each other to define a circular opening at their distal ends. The petals are enclosed with a highly resilient member of generally truncated conical shape having an integral end portion which covers the circular opening. In the sealed position, the end portion defines a closed elongate channel along the longitudinal axis of the applicator, hermetically sealing the tip within the applicator and sealing around any debris that may be within the channel. In the open position, the end portion defines an open elongate channel, resulting from a shoulder associated with the tip forcing the ends of the petals outward to stretch the end portion of the resilient member as the tip is moved to the open position, thereby to open the closed channel, without the tip contacting the end portion. When the device is moved to its sealed position, the petals urge the channel closed. In another embodiment, the sealing device is moved between its open and sealed positions through the contraction and relaxation of a spring extension of the sealing device.

15 Claims, 4 Drawing Sheets

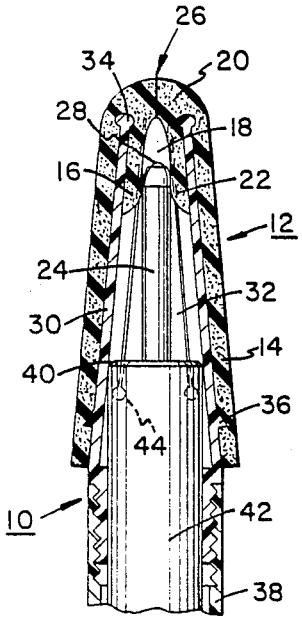
FIG. 1
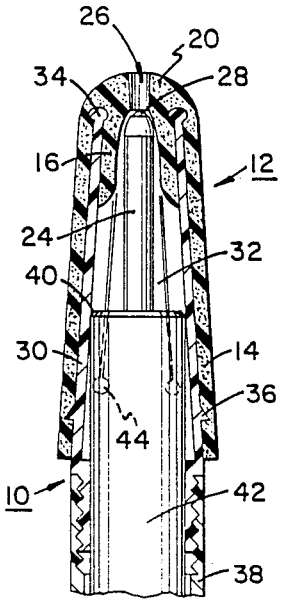
FIG. 2
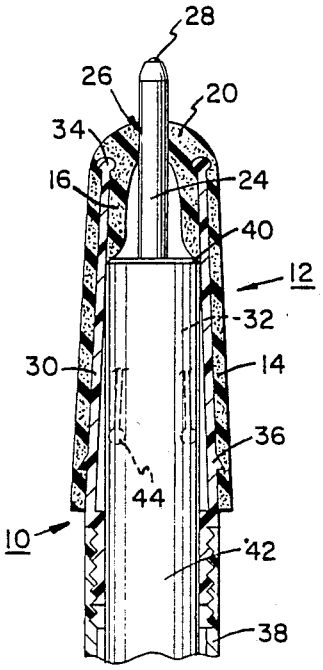
FIG. 3
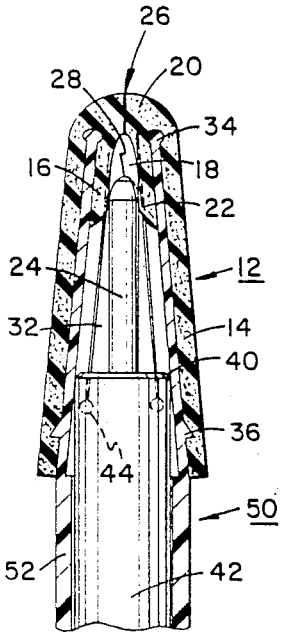
FIG. 4
FIG. 6
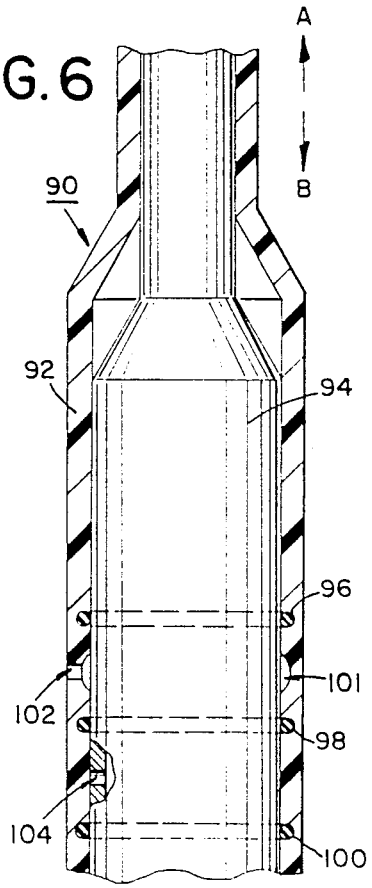
FIG. 5
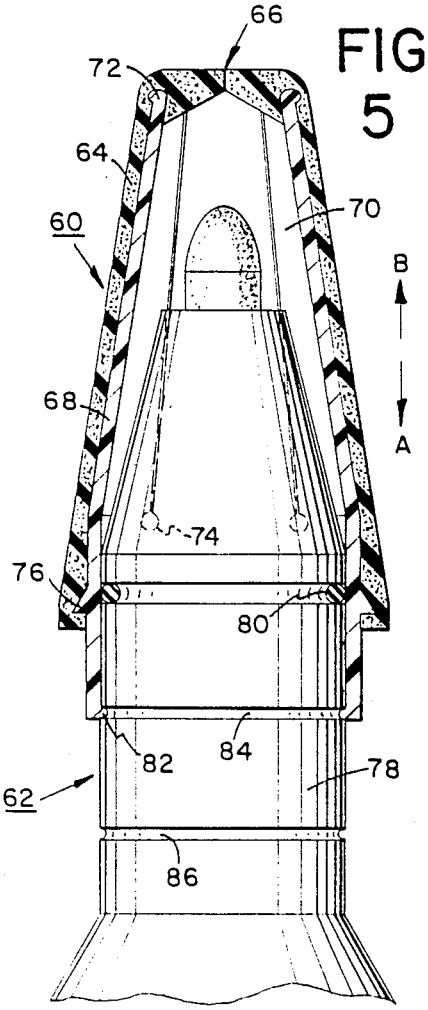

FIG. 14
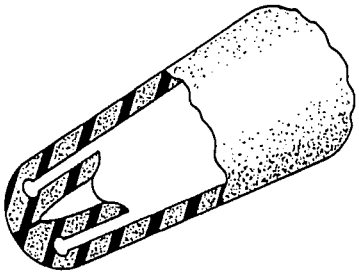
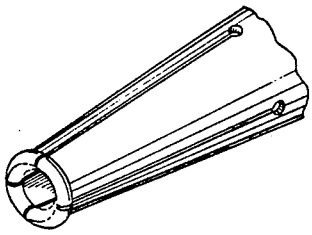
FIG. 15

ENCLOSURE MEANS FOR LIQUID APPLICATORS

This is a continuation-in-part of co-pending application Ser. No. 078,229 filed on July 27, 1987, now abandoned.

BACKGROUND OF THE INVENTION

1. Field of the Invention

This invention relates generally to implements for applying liquids to various surfaces, and more particularly to means for automatically sealing the tip end of such implements when not in use so as to provide an air-tight enclosure, and one that will function even when debris is present on the sealing surfaces. In a preferred embodiment, means automatically seal vent means when in the non-use state.

2. Background Art

The types of liquid applicators for which the present invention is intended are varied and generally, but not exclusively, include those which have an extendable element with an application tip at the end thereof to apply a liquid to a surface when in use and which element and tip are retractable within a tubular member when not in use. Such applicators may include fountain pens, "felt tip" markers, ball point pens, and paint and nail polish brushes. Since the liquids employed in these applicators usually have volatile components, it is desirable to provide an air-tight enclosure for the application tip when not in use to prevent evaporation of the volatile components. It is also desirable to seal out dirt and to prevent the unintended contact of the tip with other objects.

There have been a number of attempts in the past to provide sealing means for the ends of the types of liquid applicators generally under consideration here. Usually, each includes a petallate structure which is forced open when the implement is extended to be used and which closes when the tip of the implement is retracted. Known attempts have been described in the following U.S. Pat. Nos.:

| Pat. No. | Inventor | Date Issued |
|---|---|---|
| 1,714965 | Ullner | May 28, 1929 |
| 1,839,817 | Walker | Jan. 5, 1932 |
| 2,291,859 | Andrews | Aug, 4, 1942 |
| 2,559,555 | Zepelovitch | Jul. 3, 1951 |
| 3,480,370 | Koeln | Nov. 25, 1969 |
| 4,218,154 | Erfer | Sep. 10, 1985 |
| 4,540,300 | Midorikawa | Sep. 10, 1985 |
| 4,575,271 | Hashimoto, et al. | Mar. 11, 1986 |
| 4,595,307 | Heyden | Jun. 17, 1986 |
| 4,629,348 | Hashimoto, et al. | Dec. 16, 1986 |
| 4,640,637 | Winthrop | Feb. 3, 1987 |

Thus, Ullner describes a cap for a fountain pen, which cap has a petallate closure at the end covering the pen point. The cap is placed over the point end of the fountain pen to cover the point when not in use. When the pen is to be used, the cap is drawn further over the pen barrel with the result that the petals of the end of the cap are forced apart. The petals are described as being of a material, presumably a metallic material, which has spring resilience to normally contract the petals toward each other. It can easily be seen that foreign matter caught between two petals would cause an incomplete seal when the cap is moved to its closed position. It can also be seen that to even approach having an airtight seal without the presence of foreign matter would require careful machining in the manufacturing process.

Walker is similar to Ullner, and differs only in that the petallate closure is more intimately joined with the body of the pen and in that the closure of the petals is assisted by an annular spring mounted circumferentially about the petals. While this device may force closure in spite of softer debris between the petals, it would not do so with harder debris.

Andrews is a relatively complicated variation of Walker and Ullner.

Zepelovitch shows a fountain pen having a resilient plug in the end of a non-petallate opening, the hole in which plug self-closes upon retraction of the point of the pen. While the plug may provide a satisfactory closure for a period of time, it is apparent that, since the point of the pen must be forced through the plug to open the hole, the hole in the plug will eventually wear, thus losing its ability to seal the opening. Additionally, such an arrangement would be unsatisfactory when used with an implement having a soft-tip, such as felt tip pen or a paint or nail polish applicator.

Koeln is a variation of Walker, with the same limitations thereof.

Erfer is also a variation of earlier petallate closure means and has the same limitations.

Midorikawa overcomes some of the limitations of the devices described above, but at the cost of considerable complexity, obviously requiring several manufacturing steps. Additionally, an inherent disadvantage of the design is that the writing element is radially unsupported for a long distance from its tip. In fact, no radial support at all is shown. It is apparent that this arrangement would result in unsatisfactory use in writing when any degree of radial force was exerted on the tip.

Hashimoto '271 discloses a relatively complex sealing arrangement consisting either of a flapper or a ball, either of which could suffer from problems with debris.

Heyden shows a closure for an implement such as a pencil or a pen comprising a resilient retractable sheath placed over the end of the implement. The sheath is drawn back away from the tip of the implement, thus opening a hole in the end of the sheath and exposing the tip. This design depends on the natural resiliency of the sheath for closure of the hole and, therefore, is susceptible to problems resulting from debris in the hole.

Hashimoto et al. '348 is directed to another flapper closure similar to Hashimoto et al. '271.

Winthrop describes a retractable finger nail polish applicator having as a closure a manually placed and removed end cap. This type of closure, which also have been commonly used on various types of writing implements and other liquid applicators, can provide adequate sealing, but has a main disadvantage the fact that there is not protection once the cap is lost. Additionally, an implement with such a closure is not as convenient to use as one with automatic closure means.

Accordingly, it is a principal object of the present invention to provide automatic closure means for retractable liquid applicators which provides an air-tight, or hermetic, seal.

It is also an object of the present invention to provide such closure means that will furnish a hermetic seal even with the presence of some debris in the closure means.

It is another object of the present invention to provide such closure means that is easily manufactured, with a minimum number of parts, and without the necessity of providing close tolerances.

It is a further object of the present invention to provide such closure means that has no contact with the tip of the applicator while the closure means is opening and closing.

It is an additional object of the present invention to provide such closure means that allows for automatic sealing of the vent hole of the applicator while such applicator is not in use.

It is yet a further object of the present invention to provide such closure means for a nonretractable applicator that is moved between sealed and open positions.

Other objects of the present invention will in part be apparent and will in part appear hereinafter.

SUMMARY OF THE INVENTION

The present invention substantially overcomes the limitations of prior known devices by providing closure means for retractable liquid applicators which include as the closing element a one piece, highly resilient, generally conical member fitted over resilient members of a petallate opening at the tip end of the applicator and having therein a channel through which the applicator tip protrudes in the extended position. In the closed, or retracted position, the channel in the conical member is urged closed, thus providing a hermetic seal and, importantly, forcing the opening in the highly resilient conical member to surround any debris. When the implement is being extended, a shoulder on a slidable member associated with the tip presses against the inside surfaces of the petals and forces open the channel in the conical member without contact thereof with the tip. Where applicable, the movement of the closure means provides automatic sealing of the vent hole of the applicator when in the retracted, or non-use, position. In one embodiment, such a closure means is provided for nonretractable liquid applicators which is moveable from a sealed position to an open position by shortening a spring which is an extension of the closure means.

BRIEF DESCRIPTION OF THE DRAWING

FIG. 1 is a partial cross-sectional longitudinal view of a liquid applicator employing the present invention, shown in the retracted position.

FIG. 2 shows the applicator of FIG. 1 in a partially extended position.

FIG. 3 shows the applicator of FIG. 1 in a fully extended position.

FIG. 4 shows the applicator of FIGS. 1 through 3 with an alternative embodiment of the present invention.

FIG. 5 is a partial cross-sectional longitudinal view of a liquid applicator of a nonretractable type employing the present invention.

FIG. 6 is a partial cross-sectional longitudinal view of means for automatically sealing the vent hole of a liquid applicator.

FIG. 14 is a fragmentary, partially sectioned perspective view of the resilient member of the present invention.

FIG. 15 is a fragmentary, perspective view of the petallate member of the present invention.

DETAILED DESCRIPTION OF THE PREFERRED EMBODIMENTS

Figure 7:
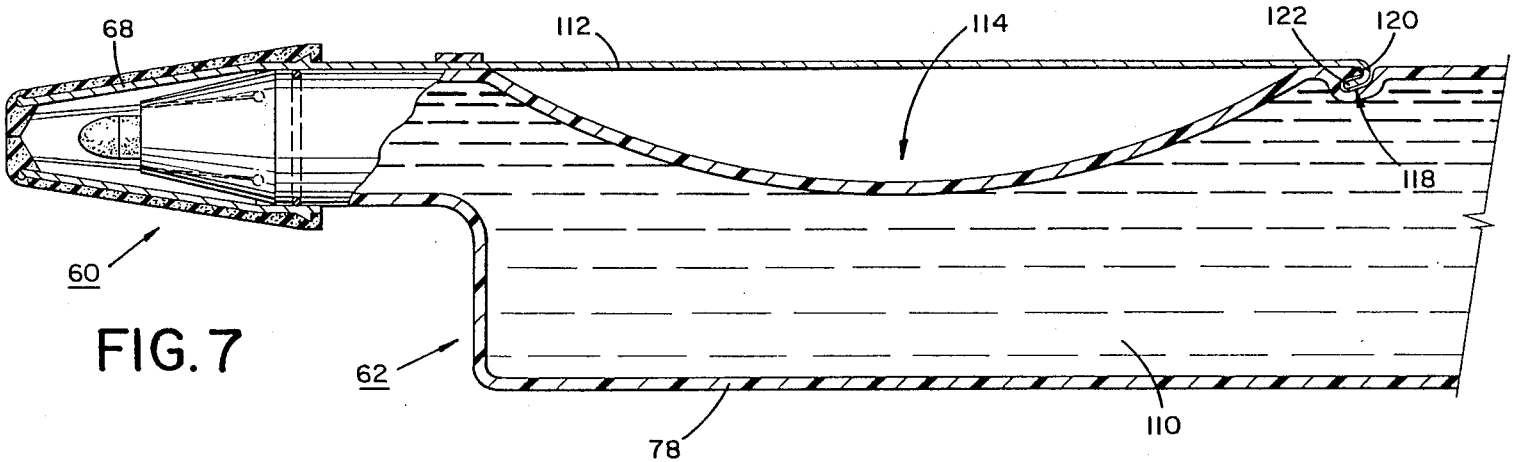
FIG. 7 is a side elevation view, partially in cross-section, of a liquid applicator showing a sealing cap applied to the applicator of FIG. 5 according to the present invention, with the sealing cap in an extended position.

Referring now to the Drawing, reference should first be made to FIGS. 14 and 15 for a full understanding of the present invention. FIG. 14 shows a resilient sealing member that is element 12 on FIGS. 1–4 and is element 64 on FIGS. 5, 7, and 8. FIG. 15 shows a partially petallate member that is element 30 on FIGS. 1–3, element 50 on FIG. 4, and element 68 on FIGS. 5, 7, and 8. FIGS. 14 and 15 show key elements of the invention before assembly and, when assembled, as shown on FIGS. 1–5 and 7 and 8, the partially petallate member of FIG. 15 is inserted into the resilient member of FIG. 14 to form a sealing cap that is element 12 on FIGS. 1–4 and element 60 on FIGS. 5, 7, and 8.

Figure 8:
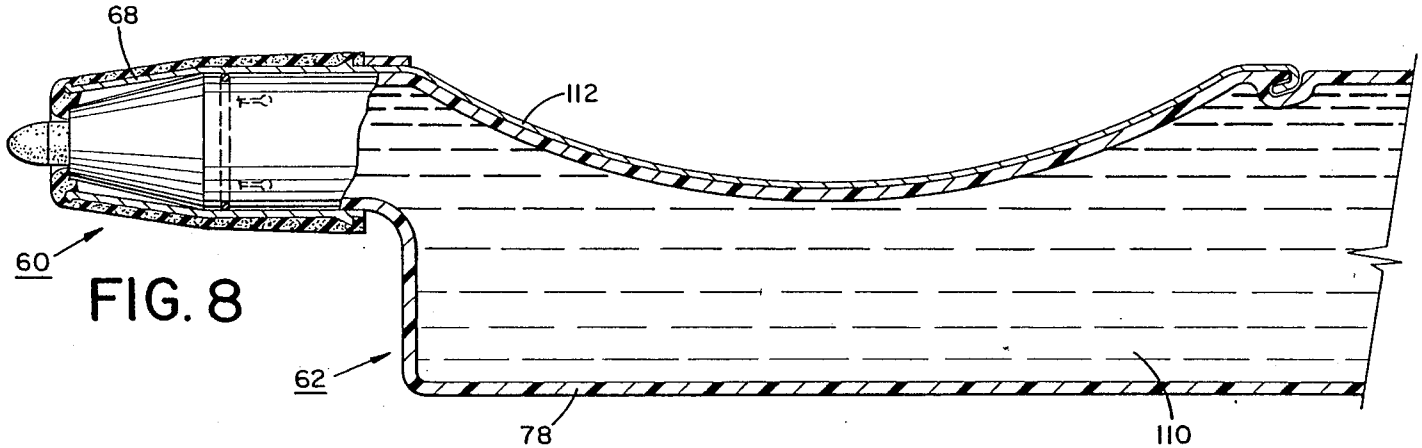
FIG. 8 is a side elevation view, partially in cross-section, of a liquid applicator showing the sealing cap of FIG. 7, with the sealing cap in a retracted position.
Figure 9:
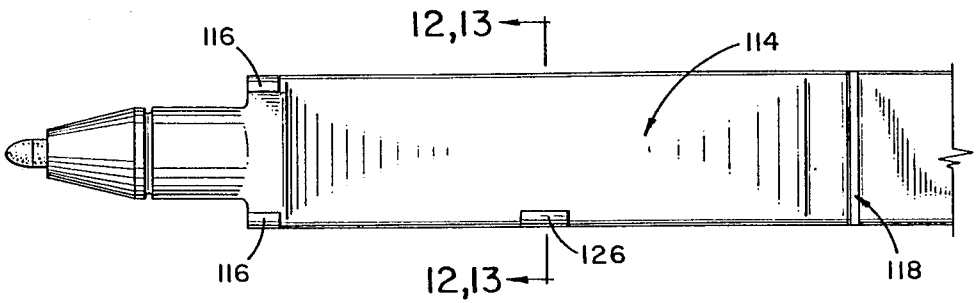
FIG. 9 is a top plan view of a liquid applicator adapted to the embodiment of the present invention shown on FIG. 7.
Figure 10:
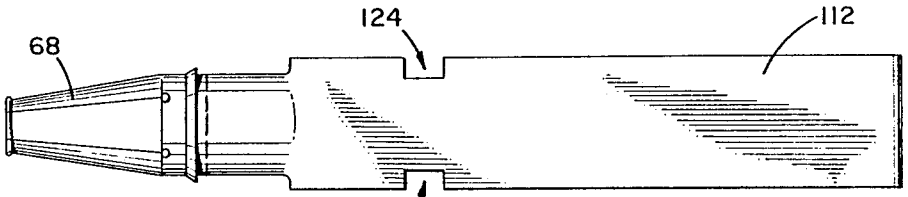
FIG. 10 is a top plan view of the partially petallate member and spring extension of a sealing cap of the present invention.

The petallate member of FIG. 15 has resilient petals that are close together in the unassembled state and, when the petallate member is inserted into the resilient member, the petals are slightly forced apart as they apply closing pressure on a channel formed in the resilient member when the sealing cap is in a closed position, as can be seen on FIGS. 1 and 4. Likewise, the sealing cap in FIGS. 5 and 7 is in the closed state and it can be seen that the resilient petals are slightly forced apart when the petallate member has been inserted into the resilient member.

FIG. 1 shows one embodiment of the present invention as applied to a ball point pen or the like, the pen being generally indicated by the reference numeral 10. Highly resilient closure means comprises a sealing cap in the general overall shape of a truncated cone, generally indicated by the reference numeral 12. Sealing cap 12 has an outer conical shell portion 14, and may have an integral inner cylindrical portion 16, which in the state shown defines a space 18, and which is located centrally radially of the shell portion, and an end portion 20. As will be seen later, the inner cylindrical portion 16 is not necessary for the practicing of the invention, but, when the nature of the implement allows, may be employed, as shown here with pen 10 in a retracted position. Cylindrical portion 16 has annular protuberances 22 extending inwardly from the inner wall of the cylinder so as to seal against and around a narrow tube 24 of pen 10, which sealing together with the closure of channel 26 in the end portion 20 of sealing cap 12 provides the small, hermetic cavity 18 for tip 28 of the pen. Sealing cap 12 grippingly fits around and is supported by and urged into its closed state by partially petallate member 30 which has resilient petals, as at 32, which have spring resilience to normally contract the petals toward each other and which in the state shown urge sealing cap 12 to its closed position, as shown on FIG. 1. Petals 32 are enlarged at the ends thereof, as at 34, so as to help secure sealing cap 12 in place and the ends define a generally circular opening. An annular rib 36 on petallate member 30 provides for additional sealing against sealing cap 12 and also provides additional means for securing the sealing cap to the member. Petallate member 30, in the embodiment shown, is threaded for attachment to barrel 38 of pen 10; although, any attachment means would be satisfactory, the same not being part of, nor important to, the practicing of the present invention.

Sealing cap 12 is preferably formed of a material such as gum rubber or a synthetic material having similar resiliency characteristics, so that, if any debris should be present in channel 26, the closing action of petals 32 together with the high resiliency of sealing cap 12 will cause the material of the sealing cap to closely surround, and tend to mold itself to, the shape of the debris and to provide a hermetic seal in spite of the presence of the debris. Petallate member 30 may be formed of any material, such as a plastic or a metal, having the proper balance of resiliency and rigidity characteristics.

FIG. 2 shows pen 10 of FIG. 1 in a partially extended position. The means for extension and retraction are not shown in these or in other figures of the Drawing and may be any of a number of different types, the type chosen not being part of, nor of importance to, the practicing of the present invention. On FIG. 2, an annular shoulder 40 on large tube member 42 of pen 10 has been moved toward channel 26 and in doing so has slidingly engaged the sloped inner walls of petals 32, thus forcing them to a more open position and, consequently, spreading end portion 20 of sealing cap 12 to cause channel 26 to open, and causing narrow tube member 24 to carry tip 28 toward, but not into contact with, end portion 20.

On FIG. 3, pen 10 is in its fully extended position and tip 28 has been carried into writing position. It is seen that shoulder 40 remains engaged with the inner surfaces of petals 32, thus providing radial support for tip 28 close to the tip. It can also be seen that channel 26 has been opened, and tip 28 been passed therethrough, without the tip having contacted any surface. Openings, as at 44, at the base of petals 32 may be provided for stress relief to reduce the possibility of cracking of petallate member 30 as the petals open. Sealing cap 12 extends to fully cover openings 44 and any spaces between petals 32, thus providing additional sealing.

It can be seen, therefore, that the embodiment of the present invention, as shown on FIGS. 1, 2, and 3 has only two elements in addition to the normal number of pen elements, each of which can be easily manufactured, for example, by well known injection molding processes, and neither of which requires careful machining or close tolerances.

FIG. 4 shows another embodiment of the present invention, in retracted position, with like elements having the same reference numerals as on FIGS. 1, 2, and 3. Here, rather than having a partially petallate element 30, as shown on FIGS. 1, 2, and 3, the end of the pen, generally indicated by the reference numeral 50, is petallate, with petals, as at 32, integral with the barrel 52 of the pen. Operation of this embodiment is the same as described with reference to FIGS. 1, 2, and 3. In this embodiment, only one additional part, the sealing cap, is required in addition to those normally found in such a device.

FIG. 5 shows an embodiment of the present invention as it might be applied to a large marker or to a paint or nail polish applicator. Here, a sealing cap of the present invention, in the closed position, generally indicated by the reference numeral 60, is adapted to be manually positioned and axially moved back and forth over the end of the applicator, generally indicated by the reference numeral 62, which embodiment is shown here in the sealed position. Sealing cap 60 includes a resilient member 64 having a channel 66 at the end thereof and a partially petallate member 68. Petallate member 68 includes resilient petals, as at 70, which have enlarged tips, as at 72, and includes openings, as at 74, and an annular rib 76, all with the functions as described with reference to like elements on FIGS. 1 through 3. Barrel 78 of applicator 62 may have one or more O-rings disposed between it and sealing cap 60, as at 80, to slidingly seal the barrel against the sealing cap as the sealing cap is moved axially along the barrel. Sealing cap 60 includes an annular ridge 82 which releasably engages circumferential depression 84 when the sealing cap is in its closed position, as shown on FIG. 5, and releasably engages circumferential depression 86 when the sealing cap is in its open position. It can be seen that applicator 62 will be put in its open position by moving sealing cap 60 in the direction "A" as indicated by the arrow, with like elements functioning the same as described with reference to FIGS. 1 through 3; and, to put applicator 62 in its sealed position, sealing cap 60 is moved in the direction "B" as indicated by the arrow. It can also be seen that the sealing cap 60 can be readily removed and used on other applicators of the same size.

FIG. 6 shows an additional sealing feature of the present invention which may be included in an embodiment. Here, a liquid applicator, generally indicated by the reference numeral 90, includes a barrel 92, a tube 94 which contains the liquid, and O-rings 96, 98, and 100. The tip end of the applicator 90 is not shown and it may include one of the embodiments of the present invention shown on FIGS. 1 or 4. In the position shown, which is the sealed position of applicator 90, vent 102 is positioned between O-rings 96 and 98, and vent 104 is shown positioned between O-rings 98 and 100. A circular vent depression 101 formed on the inner circumference of barrel 92 may be included to facilitate the communication of barrel vent 102 with tube vent 104. Thus, it is seen that, in the closed position, the liquid in tube 94 is sealed against evaporation from the tube vent 104 and the tip end of the pen is further sealed from barrel vent 102. When applicator 90 is moved to its open position by sliding tube 94 in direction "A", vent 104 will be positioned with vent 102 between O-rings 96 and 98 to allow venting of tube 94 as the liquid therein is consumed. To effect sealing of tube vent 104, tube 94 is moved in direction "B" to the position shown in FIG. 6. It can be seen from FIG. 6 that, when applicator 90 is in its open position, both the tip end and vent 104 experience atmospheric pressure, thus there is continuous venting and no pressure differential can develop to affect the rate of flow of the fluid. Likewise, when applicator 90 is moved to its sealed position, the tip end (utilizing the sealing cap) and tube vent 104 are simultaneously sealed, thus preventing any pressure differential between the two which could cause leaking from the tube vent 104 or the applicator tip. It can also be seen that there is virtually no air space between cartridge 94 and barrel 92 defined by the space between O-rings 98 and 100. This further minimizes the drying out of the fluid in cartridge 94 through tube vent 104.

It will be understood that sealing cap 60 of FIG. 5 could be adapted as well to provide for automatic vent sealing if desired.

FIGS. 7 through 13 show an embodiment of the present invention, generally indicated by the reference numeral 60, which is retractable and which may be applied to applicator 62 when it is filled with an appropriate liquid 110. Here, partially petallate member 68 has an extension in the form of spring means 112 which extends over a depression 114 formed in the top of barrel 78 of applicator 62. When spring means 112 is in the position shown on FIG. 7, applicator 62 is in its sealed position. When it is desired to put applicator 62 in its open position, spring means 112 is manually biased away from its normal position by pressing it into depression 114 to shorten the overall length of the spring means and the sealing cap is thereby drawn to the position shown on FIG. 8. Spring means 112 may be guided and slidingly held in place on barrel 78 by retaining means 116 and trough 118 on top of the barrel 78, the lip 120 of which trough engages hook shaped end 122 of spring means 112 to anchor the end of the spring means therein.

Spring means 112 may have cutouts 124 to aid in assembling sealing cap 60 to applicator 62 by placing the spring means adjacent the top of barrel 78 to that cutouts 124 clear retaining means 116. Sealing cap 60 is then further moved back over applicator 62 until hook shaped end 122 reaches trough 118 and is forced thereinto so that the hook shaped end will be retained in the trough when spring means 112 is depressed and relaxed.

Barrel 78 may include a spring retraction flange 126 on barrel 78, having a hook shaped lip 128 to aid in holding spring means 112 in its depressed state. In operation, spring means 112 is depressed, to move applicator 62 to its open state, so that the left edge of spring means 112, as seen on FIG. 12, moves under hook shaped lip 128 to the position "B" and the spring means is held in that position by the lip and by continued manual pressure of the human operator (not shown). Again referring to FIG. 12, when it is desired to move applicator 62 to its sealed state, spring means 112 is moved slightly to the right to release it to the position "C" and sealing cap 60 will move over the end of applicator 62 as spring means 112 moves to position "A".

Figure 13:
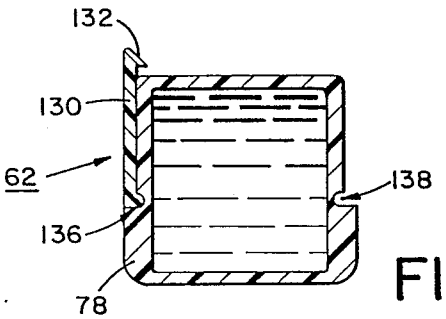
FIGS. 12 and 13 are cross-sectional views of applicators adapted for sealing caps of the present invention.
Figure 11:
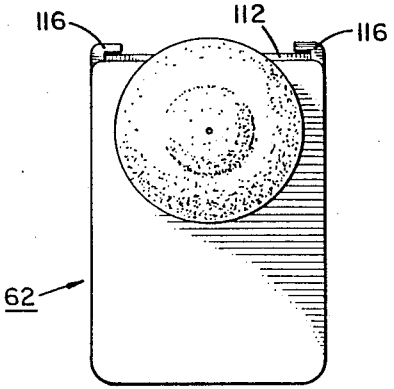
FIG. 11 is a front plan view of an applicator constructed for use with a sealing cap of the present invention.
Figure 12:
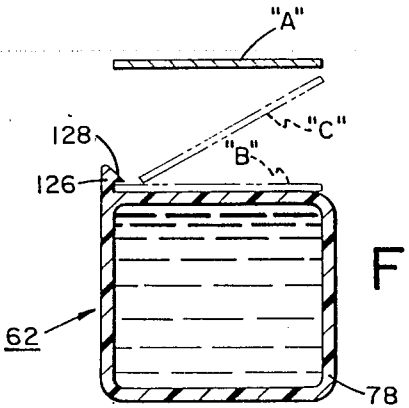

FIG. 13 shows barrel 78 adapted to include a moveable spring retraction flange 130 having a hook shaped lip 132 with the same function as spring retraction flange 126 and hook shaped lip 128 on FIG. 12. Here, spring retraction flange 130 includes a retaining flange which may engage either of slots 136 or 138 to accommodate either righthanded or lefthanded users. When spring retraction flange 130 is located as shown on FIG. 13, with the retaining flange engaging slot 136, it would be most convenient for a righthanded user; and, when the spring retraction flange were located with the retaining flange engaging slot 138, it would be most convenient for lefthanded users. Retaining flange 134 may be removably held in either of slots 136 or 138 by friction or by any of a number of known mechanical means, the one chosen not being critical to, or part of, the present invention.

Thus, is will be understood that what has been described is means for automatically sealing the end of retractable liquid applicators and one which provides for an air-tight seal even with the presence of debris on the sealing surfaces, the sealing means being easily manufactured with a minimum number of parts and without need for close tolerances. Additionally, the sealing means does not come in contact with the applicator tip and provides support radially for the tip as the tip is being used.

It will also be understood that the objects set forth above, among those made apparent from the preceding description, are efficiently attained and, since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, which, as a matter of language, might be said to fall therebetween.

I claim:

1. A sealing device for a liquid applicator of the type having elongated barrel means having first and second ends, with tube means containing liquid slideably mounted in said barrel means for movement between a retracted position and an extended position, said tube means having a liquid application tip at one end thereof for protrusion from said first end of said barrel means, comprising:

(a) a partially petallate member having first and second end sections, with said first end section being of generally cylindrical shape and fixedly attached to said first end of said barrel means, with said second end section being petallate and of generally truncated conical shape having spaced apart resilient petals protruding radially inward so that the ends thereof define a circular opening smaller than that of said first end section, which circular opening is symmetrically around, and lies in a plane perpendicular to, the longitudinal axis of said tube means, the inside of the petals defining a sloped surface between said first end section and said circular opening of said second end section;

(b) a highly resilient member of generally truncated conical shape, having an outer shell portion fitting grippingly around the petallate end of said partially petallate member, which extends over said petallate member to cover at least the spaces between the petals, and which has an integral end portion covering said circular opening in said second end section;

(c) in said retracted position, said end portion defining a closed elongate channel along the longitudinal axis of the tube means, resulting from said petals forcing said integral end portion toward its longitudinal axis, hermetically sealing said tip within said resilient member; and (d) in said extended position, said end portion defining an open elongate channel, resulting from a shoulder formed on the circumference of said tube means, which shoulder slidingly engages said sloped inside surface of said petals as said tube means is moved to said extended position, forcing said ends of said petals outward to stretch said end portion of said resilient member, thereby to open said channel through which said tip protrudes, without said tip contacting said resilient member.

2. A sealing device, as defined in claim 1, wherein said resilient member has an integral, continuous cylindrical portion concentric with and extending inward from the channel, which circumferentially grips and seals said tube means when in said retracted position, so that in said retracted position, said tip is sealed in a cavity defined by said cylindrical portion, said end of said resilient member, and the area where said cylindrical portion grasps said tube means.

3. A sealing device, as defined in claim 1, wherein said partially petallate member is integral with said barrel means.

4. A sealing device, as defined in claim 1, wherein said partially petallate member is removably attached to said first end of said barrel means.

5. A sealing device, as defined in claim 1, wherein when said tube means includes a first vent hole in the side thereof and said barrel means includes a second vent hole in the side thereof, said sealing means further comprises:

(a) first resilient sealing means on the side of said first vent hole nearest said second end of said barrel means;

(b) second resilient sealing means between said first and second vent holes; whereby, when said tube means is in said retracted position, said first vent hole is sealed within said barrel means between said first and second sealing means; and (c) third resilient sealing means between said second vent hole and said first end of said barrel means; whereby, when said tube means is in said retracted position, said first end of said barrel means is sealed from said second vent hole;

whereby, when said tube means is in said extended position, said first and second vent holes are both between said first and second sealing means and communicate with each other therein.

6. A sealing device, as defined in claim 5, wherein said resilient sealing means comprises O-rings disposed between said tube means and said barrel means.

7. A sealing device for a liquid applicator of the type having a relatively large application tip fixedly mounted at a first end of a relatively large tube containing liquid, which tube is of the nonretractable type, comprising:

(a) a partially petallate member having a cylindrical first end attached to said first end of said tube and having a petallate second end with resilient spaced apart petals protruding radially inward so as to define a circular opening smaller than said cylindrical first end, symmetrically around, and lying in a plane perpendicular to, the longitudinal axis of said tube, the inside of said petals defining a sloped surface between said larger first end and said smaller second end;

(b) a highly resilient member of truncated conical shape, having an outer shell portion which fits grippingly around the petallate end of said partially petallate member, which extends over said member to cover at least the spaces between said petals, and which has an integral end portion covering said opening;

(c) in a closed position of said sealing device, said end portion defining a closed elongate channel along said longitudinal axis of said tube, resulting from said petals forcing said integral end portion toward its longitudinal axis, hermetically sealing said tip within said resilient member; and (d) in an open position of said sealing device, the end portion defining an open elongate channel, resulting from a shoulder formed on the circumference of said tube, which shoulder slidingly engages said sloped inside surface of said petals as said petallate member is pulled toward a second end of said tube, forcing the ends of said petals outward to stretch the end portion of the resilient member, thereby to form the channel through which said tip protrudes, without said tip contacting said resilient member.

8. A sealing device, as defined in claim 7, wherein at least one resilient sealing means is provided between said tube and said cylindrical first end of said partially petallate member.

9. A sealing device, as defined in claim 8, wherein said sealing means comprises an O-ring.

10. A sealing device, as defined in claim 7, further comprising:

(a) spring means formed as an extension of said partially petallate member and extending over at least a portion of said tube;

(b) the distal end of said spring means being anchored to said tube; and (c) said spring means being adapted to be biased from its normal position so as to shorten the overall length of said spring means;

whereby; when said spring means is biased from its normal position, said partially petallate member will move to an open position and, when said spring means is allowed to return to its normal position, said partially petallate member will move to a closed position.

11. A sealing device, as defined in claim 10, wherein said spring means can be biased from said normal position by pressing said spring means into a depression formed on said tube.

12. A sealing device, as defined in claim 10, wherein said spring means is adapted to be slidingly held by retaining means formed on said liquid applicator.

13. A liquid applicator of the type having a liquid application tip a one end and having a sealing device with first and second positions, with said tip enclosed in said sealing device when said sealing device is in said first position and being exposed for use when said sealing device is in said second position, said sealing device being moved from said first position to said second position by biasing away from a normal position springs means formed as an extension of said sealing device and extending over at least a portion of said applicator, comprising:

(a) an elongate body for containing said liquid;

(b) said body having said application tip mounted at a first end thereof;

(c) said sealing device being adapted for axial back-and-forth motion relative to said body;

(d) said spring means extending over at least a portion of said body;

(e) the distal end of said spring means being anclored to said body; and (f) said body having formed therein a depression extending under at least a portion of said spring means so that said spring means can be biased into said depression, such that biasing of said spring means into said depression will cause said sealing device to move from its first to its second position.

14. A sealing device, as defined in claim 11, wherein said spring means is adapted to be retained in said biased position by flange means formed on said liquid applicator.

15. A sealing device, as defined in claim 14, wherein said flange means may be removably positioned to accommodate either righthanded or lefthanded users.

* * * * *